US008925414B1

(12) United States Patent
Park et al.

(10) Patent No.: US 8,925,414 B1
(45) Date of Patent: Jan. 6, 2015

(54) DEVICES FOR INPUTTING COMMAND SIGNALS TO MARINE VESSEL CONTROL SYSTEMS

(75) Inventors: John I. S. Park, Fond du Lac, WI (US); Steven J. Gonring, Slinger, WI (US)

(73) Assignee: Brunswick Corporation, Lake Forest, IL (US)

( * ) Notice: Subject to any disclaimer, the term of this patent is extended or adjusted under 35 U.S.C. 154(b) by 640 days.

(21) Appl. No.: 13/221,493

(22) Filed: Aug. 30, 2011

(51) Int. Cl.
*G05G 9/047* (2006.01)
*G05G 5/06* (2006.01)
*G05G 1/10* (2006.01)
*B63H 21/21* (2006.01)

(52) U.S. Cl.
CPC ..... *B63H 21/21* (2013.01)
USPC ..... 74/471 XY; 74/523; 74/527; 74/543; 440/87; 180/315; 73/1.37; 447/113; 345/161; 137/636.1; 137/636.2; 338/128; 335/170

(58) Field of Classification Search
CPC ..... B63H 21/213
USPC ..... 440/87; 74/471 XY; 180/315; 73/1.37; 477/113; 345/161; 137/636.1, 636.2; 335/170; 338/128
See application file for complete search history.

(56) References Cited

U.S. PATENT DOCUMENTS 2,617,311 A * 11/1952 Miller ..... 477/113
2,966,970 A * 1/1961 Morse ..... 477/113
2,973,661 A * 3/1961 Sznycer ..... 74/471 R
3,219,782 A * 11/1965 Bissell et al. ..... 335/170
3,824,879 A 7/1974 Hansgen et al.
3,919,510 A * 11/1975 Barnes ..... 200/61.88
4,056,073 A 11/1977 Dashew et al.
4,213,353 A 7/1980 Floeter
4,632,232 A * 12/1986 Kolb et al. ..... 477/112
4,733,214 A * 3/1988 Andresen ..... 338/128
4,747,359 A 5/1988 Ueno
4,777,981 A * 10/1988 Petro ..... 137/636.2
5,062,516 A 11/1991 Prince
5,090,929 A 2/1992 Rieben
5,453,030 A 9/1995 Broussard
5,492,493 A 2/1996 Ohkita
5,831,596 A * 11/1998 Marshall et al. ..... 345/161
5,857,492 A * 1/1999 Salamun ..... 137/636.1
5,878,628 A * 3/1999 Ongaro et al. ..... 74/548
5,967,867 A 10/1999 Rinzaki et al.
6,047,609 A 4/2000 Brower
6,142,841 A 11/2000 Alexander, Jr.
6,234,853 B1 5/2001 Lanyi et al.
6,511,354 B1 1/2003 Gonring et al.
6,866,022 B1 3/2005 Phillips et al.
6,994,046 B2 2/2006 Kaji et al.

(Continued)

FOREIGN PATENT DOCUMENTS

WO 2009/080987 A1 7/2009

*Primary Examiner* — Vinh Luong
(74) *Attorney, Agent, or Firm* — Andrus Intellectual Property Law LLP

(57) ABSTRACT

A device for inputting command signals to a marine vessel control system includes a lever that is selectively operable in a joystick mode and a lever mode. In the lever mode, the lever is confined to pivoting about a horizontal axis to thereby input throttle and shift commands to the control system. In the joystick mode, the lever is freely pivotable in all directions away from a vertical axis that is perpendicular to the horizontal axis to thereby input throttle, shift, and directional commands to the control system.

14 Claims, 7 Drawing Sheets

(56) References Cited

U.S. PATENT DOCUMENTS

| | | | | |
|---|---|---|---|---|
| RE39,032 | E | 3/2006 | Gonring et al. | |
| 7,137,475 | B2 * | 11/2006 | Shiomi et al. | 180/315 |
| 7,267,068 | B2 | 9/2007 | Bradley et al. | |
| D554,080 | S | 10/2007 | Iekura | |
| D554,596 | S | 11/2007 | Iekura | |
| 7,305,928 | B2 | 12/2007 | Bradley et al. | |
| 7,467,595 | B1 | 12/2008 | Lanyi et al. | |
| 7,699,674 | B1 | 4/2010 | Wald et al. | |
| 7,727,036 | B1 | 6/2010 | Poorman et al. | |
| 2006/0207310 | A1 * | 9/2006 | Kuwata et al. | 73/1.37 |

* cited by examiner

DEVICES FOR INPUTTING COMMAND SIGNALS TO MARINE VESSEL CONTROL SYSTEMS

FIELD

The present disclosure is generally related to devices for inputting command signals to marine vessel control systems, such as for example shift and throttle levers, joysticks, and/or the like.

BACKGROUND

U.S. Pat. No. RE39,032, the disclosure of which is hereby incorporated herein by reference in entirety, discloses a multipurpose control mechanism that allows an operator of a marine vessel to use the mechanism as both a standard throttle and gear selection device and, alternatively, as a multi-axis joystick command device. The control mechanism comprises a base portion and a lever that is movable relative to the base portion along with a distal member that is attached to the lever for rotation about a central axis of the lever. A primary control signal is provided by the multipurpose control mechanism when the marine vessel is operated in a first mode in which the control signal provides information relating to engine speed and gear selection. The mechanism can also operate in a second or docking mode and provide first, second and third secondary control signals relating to desired maneuvers of the marine vessel.

SUMMARY

The present disclosure arose from the present inventors' research and development of control mechanisms and devices, such as the multipurpose control mechanism described in the reissue patent incorporated herein above.

During research and development, the inventors realized that it would be desirable to provide an input device that selectively functions as (1) a shift and throttle lever for inputting shift and throttle commands to the marine vessel control system and (2) a joystick for inputting shift and throttle and directional commands to the marine vessel control system for 360 degree movement of the vessel. The inventors realized that such a combination device would provide ergonomic advantages to the operator, both easing operation and saving space at the helm for other equipment and instruments. Through such research and development, the inventors conceived of the presently disclosed examples, which among other advantages, provide simple and more intuitive operator interfaces than the prior art.

According to this disclosure, input devices are disclosed that can be selectively operated in a "lever mode" providing shift and throttle commands (typically for cruising operations) and in a "joystick mode" providing shift and throttle and directional commands (typically for docking operations). In the joystick mode, the devices allow for both directional and magnitude ("position-based") commands, allowing for more responsive control of the marine vessel than prior art devices.

In one example, a device for inputting command signals to a marine vessel control system can include a lever that is selectively operable in the joystick mode and the lever mode. In the lever mode, the lever is confined to pivoting about a horizontal axis to thereby input throttle and shift commands to the control system. In the joystick mode, the lever is freely pivotable in all directions away from a vertical axis that is perpendicular to the horizontal axis to thereby input throttle, shift, and directional commands to the control system.

The lever can include a housing and a handle. In the lever mode, the housing can be pivotable with respect to the horizontal axis while the handle is held stationary with respect to the housing. In the joystick mode, the housing can be held stationary while the handle is freely pivotable in all directions away from the vertical axis. A lock can selectively lock the lever for operation in one of the lever mode and joystick mode and unlock the lever for operation in the other of the lever mode and the joystick mode. An input device can be provided for actuating the lock.

Further examples are disclosed herein with reference to the following drawing figures.

DETAILED DESCRIPTION OF THE DRAWINGS

In the present disclosure, certain terms have been used for brevity, clearness and understanding. No unnecessary limitations are to be inferred therefrom beyond the requirement of the prior art because such terms are used for descriptive purposes only and are intended to be broadly construed. The different systems, devices and methods described herein may be used alone or in combination with other systems, devices and methods. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

Figure 1:
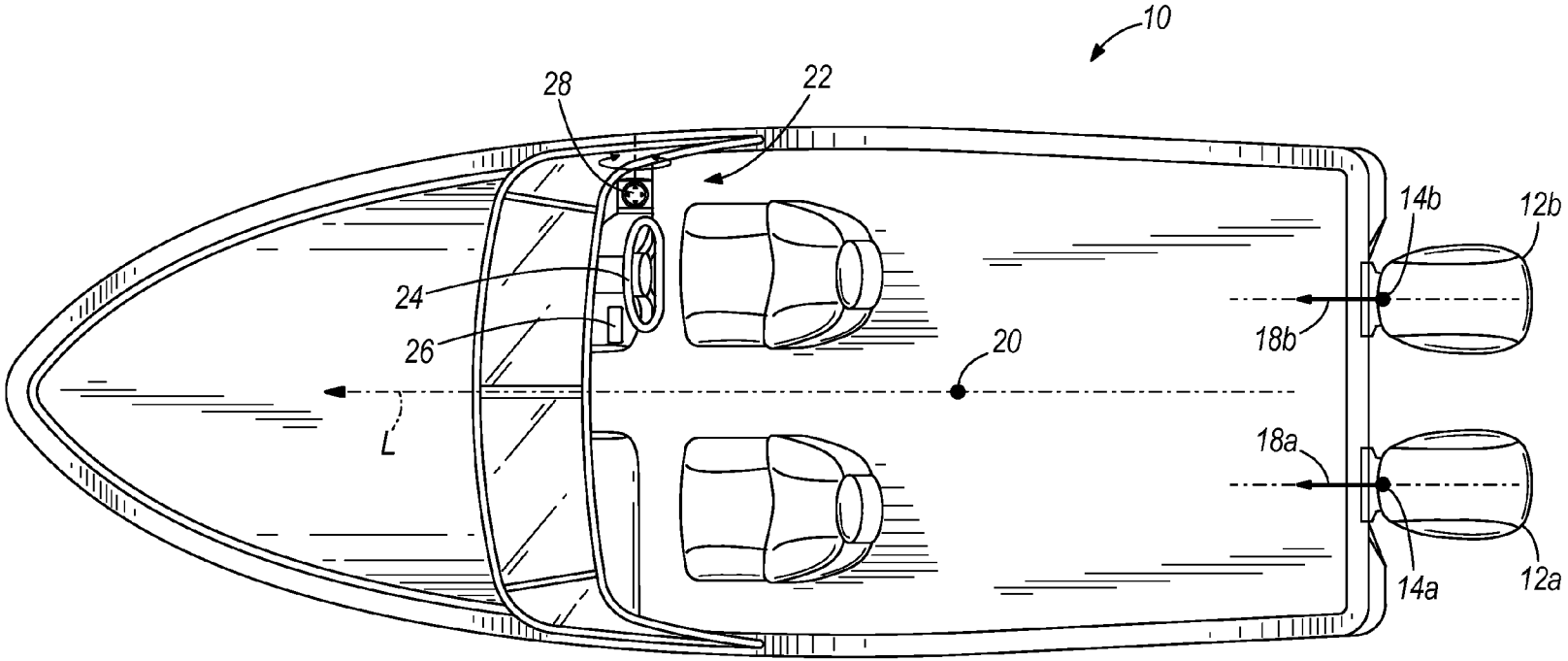
FIG. 1 is a top view of a marine vessel having a pair of marine propulsion devices in an aligned orientation.

FIG. 1 depicts a marine vessel 10 having port and starboard propulsion devices 12*a*, 12*b*, which in the example shown are outboard motors. Although a particular example having two propulsion devices is shown and described, the concepts of the present disclosure are applicable to marine vessels having any number of propulsion devices. Configurations with less than or more than two marine propulsion devices are contemplated. Parts of this disclosure and claims refer to a "propulsion device"; however, these descriptions are intended to equally apply to arrangements having "one or more propulsion devices". The concepts in the present disclosure are applicable to marine vessels having any type or configuration of propulsion device, such as for example internal combustion engines, electric motors, and/or hybrid systems configured as an inboard drive, outboard drive, inboard/outboard drive, stern drive, and/or the like. The propulsion devices can include any type of propulsor such as propellers, impellers, pod drives and/or the like.

The marine propulsion devices 12*a*, 12*b* are each rotatable in clockwise and counterclockwise directions through a substantially similar range of rotation about respective steering axes 14*a*, 14*b*. Rotation of the marine propulsion devices 12*a*, 12*b* is facilitated by conventional steering actuators 16*a*, 16*b* (see FIG. 7). Steering actuators for rotating marine propulsion devices are well known in the art, examples of which are provided in U.S. Pat. No. 7,467,595, the disclosure of which is hereby incorporated herein by reference in its entirety. Each marine propulsion device 12*a*, 12*b* creates propulsive thrust in both forward and reverse directions to, in turn, maneuver the marine vessel 10, as is conventional. FIG. 1 shows the marine propulsion devices 12*a*, 12*b* operating in forward gear, such that resultant forwardly acting thrust vectors 18*a*, 18*b* on the marine vessel 10 are produced; however, it should be recognized that the propulsion devices 12*a*, 12*b* could also be operated in reverse gear and thus provide oppositely oriented (i.e. reversely acting) thrust vectors on the vessel 10.

As shown in FIG. 1, the propulsion devices 12*a*, 12*b* are aligned in a longitudinal direction L to thereby define thrust vectors 18*a*, 18*b* extending in the longitudinal direction L. The particular orientation shown in FIG. 1 is often employed to achieve a forward or backward movement of the marine vessel 10 in the longitudinal direction L or a rotational movement of the vessel 10 with respect to the longitudinal direction L. Specifically, operation of the propulsion devices 12*a*, 12*b* in forward gear causes the marine vessel 10 to move forwardly in the longitudinal direction L. Conversely, operation of propulsion devices 12*a*, 12*b* in reverse gear causes the marine vessel 10 to move reversely in the longitudinal direction L. Further, operation of one of propulsion devices 12*a*, 12*b* in forward gear and the other in reverse gear causes rotation of the marine vessel 10 about a center of turn 20 with respect to the longitudinal direction L. The center of turn 20 represents an effective center of gravity for the marine vessel 10; however, it will be understood by those having ordinary skill in the art that the location of the center of turn 20 is not, in all cases, the actual center of gravity of the marine vessel 10. That is, center of turn 20 can be located at different locations than the actual center of gravity that would be calculated by analyzing the weight distribution of various components of the marine vessel 10. This concept and related concepts are recognized by those having ordinary skill in the art with reference to the center of turn, instantaneous center of turn in U.S. Pat. No. 6,234,853, and instantaneous center in U.S. Pat. No. 6,994,046, which are hereby incorporated herein by reference in entirety. Various other maneuvering strategies and mechanisms are described in U.S. Pat. Nos. 6,234,853; 7,267,068; and 7,467,595, which are hereby incorporated herein by reference in entirety.

Figure 2:
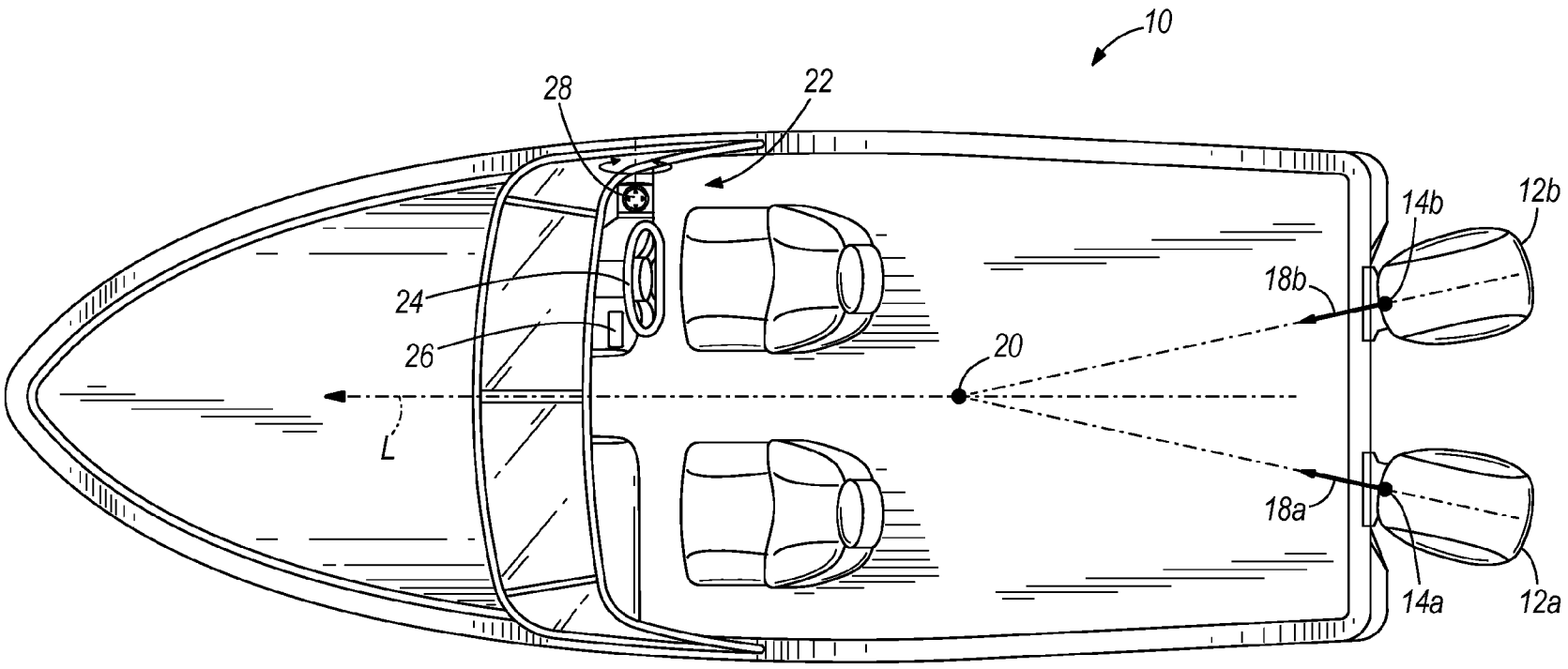
FIG. 2 is a top view of the marine vessel, wherein the marine devices are in an inwardly splayed orientation.

As shown in FIG. 2, the marine propulsion devices 12*a*, 12*b* are rotated out of the aligned position shown in FIG. 1 so that the marine propulsion devices 12*a*, 12*b* and their resultant thrust vectors 18*a*, 18*b* are not aligned in the longitudinal direction L. In the example shown in FIG. 2, the marine propulsion devices 12*a*, 12*b* are splayed inwardly and operated so as to provide thrust vectors 18*a*, 18*b* that are aligned with a common point, which in this example is the center of turn 20. This orientation is commonly utilized to obtain lateral movement of the vessel 10 with respect to the longitudinal direction L. In addition to the example shown in FIG. 2, various other unaligned positions and relative different or equal amounts of thrust of marine propulsion devices 12*a*, 12*b* are possible to achieve one or both of a rotational movement and a movement of the vessel 10 in any direction, including laterally to and along the longitudinal direction L.

The orientation of marine propulsion devices 12*a*, 12*b* shown in FIG. 1 is often employed during a "lever mode", wherein forward and reverse translations of the vessel 10 with respect to the longitudinal direction L are requested, typically for example to move the vessel through open water. Conventionally, these types of lateral movements are requested via a combination shift/throttle lever that is pivotable about a horizontal axis that is perpendicular to the longitudinal direction L. An example of this type of device is shown in U.S. Pat. No. 6,866,022, which is hereby incorporated herein by reference in entirety. Conversely, the orientation of marine propulsion devices 12*a*, 12*b* shown in FIG. 2 is often employed during a "joystick mode" of a control system 30 (see FIG. 7) of the marine vessel 10, wherein lateral movements of the marine vessel 10 with respect to the longitudinal direction L are requested, typically for example during docking of the vessel 10. Conventionally, these types of lateral movements are requested by an operator via a conventional joystick that is pivotable in 360-degree motion away from vertical, such as for example the joystick shown and described in U.S. Pat. No. 7,305,928, which is hereby incorporated herein by reference. The respective orientations of marine propulsion devices 12*a*, 12*b* shown in FIGS. 1 and 2 can also be employed during the aforementioned "joystick mode" when yaw of the marine vessel 10 is requested by the joystick, such as for example by turning the handle on the joystick. This concept is disclosed in the incorporated U.S. Pat. No. RE39,032.

Figure 3:
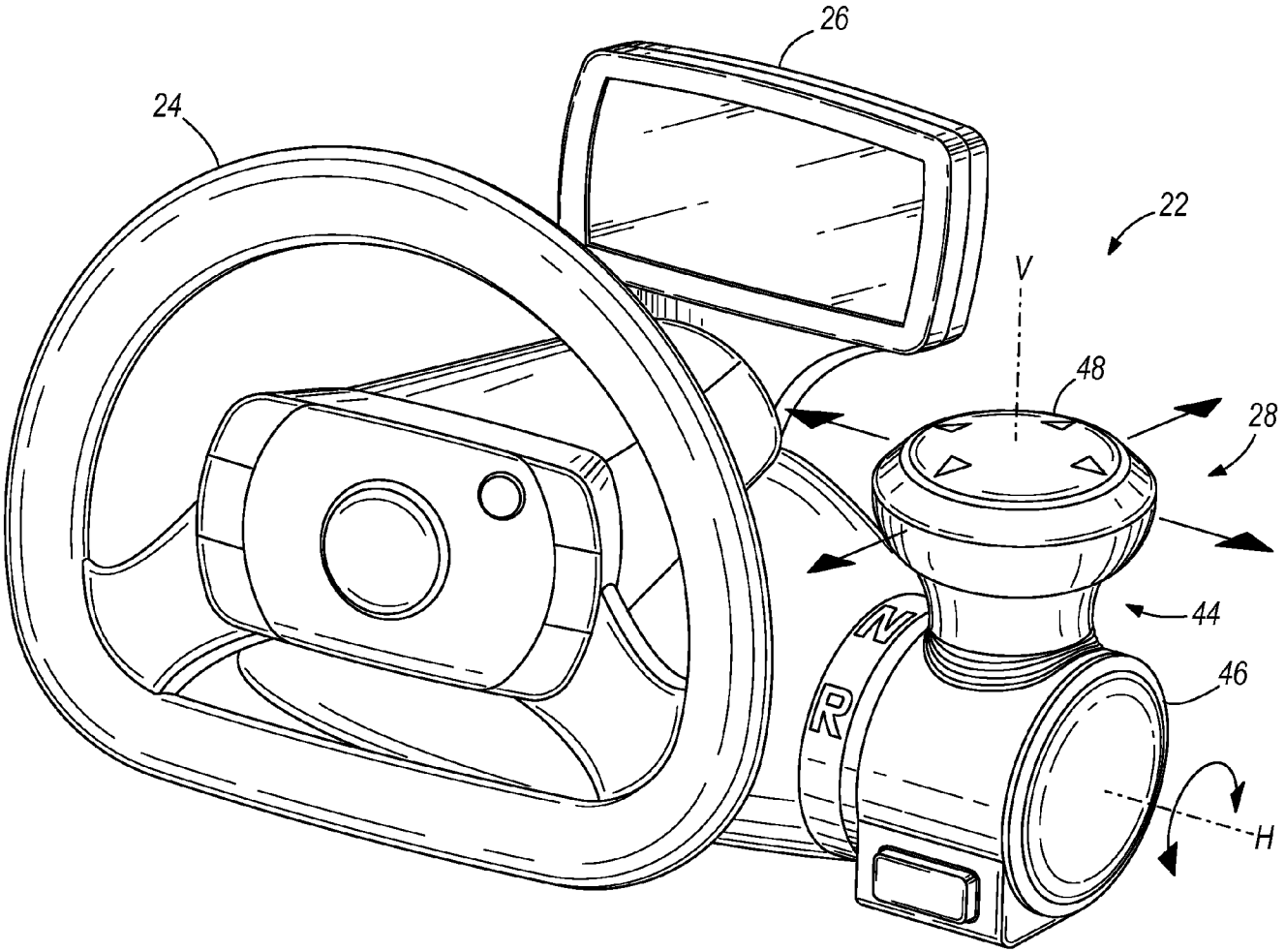
FIG. 3 is an isometric view of a helm of a marine vessel having a steering wheel, a touch screen and an input device for inputting command signals to a marine vessel control system.

Referring to FIG. 3, the marine vessel 10 includes a helm 22, where an operator can input commands for maneuvering the marine vessel 10 via one or more input devices. The input devices include a steering wheel 24, a touch screen 26, and a device 28 described further herein below for inputting commands to the control system 30 (see FIG. 7) according to at least both of the joystick mode and the lever mode. The number and type of input devices can vary from that shown.

Figure 7:
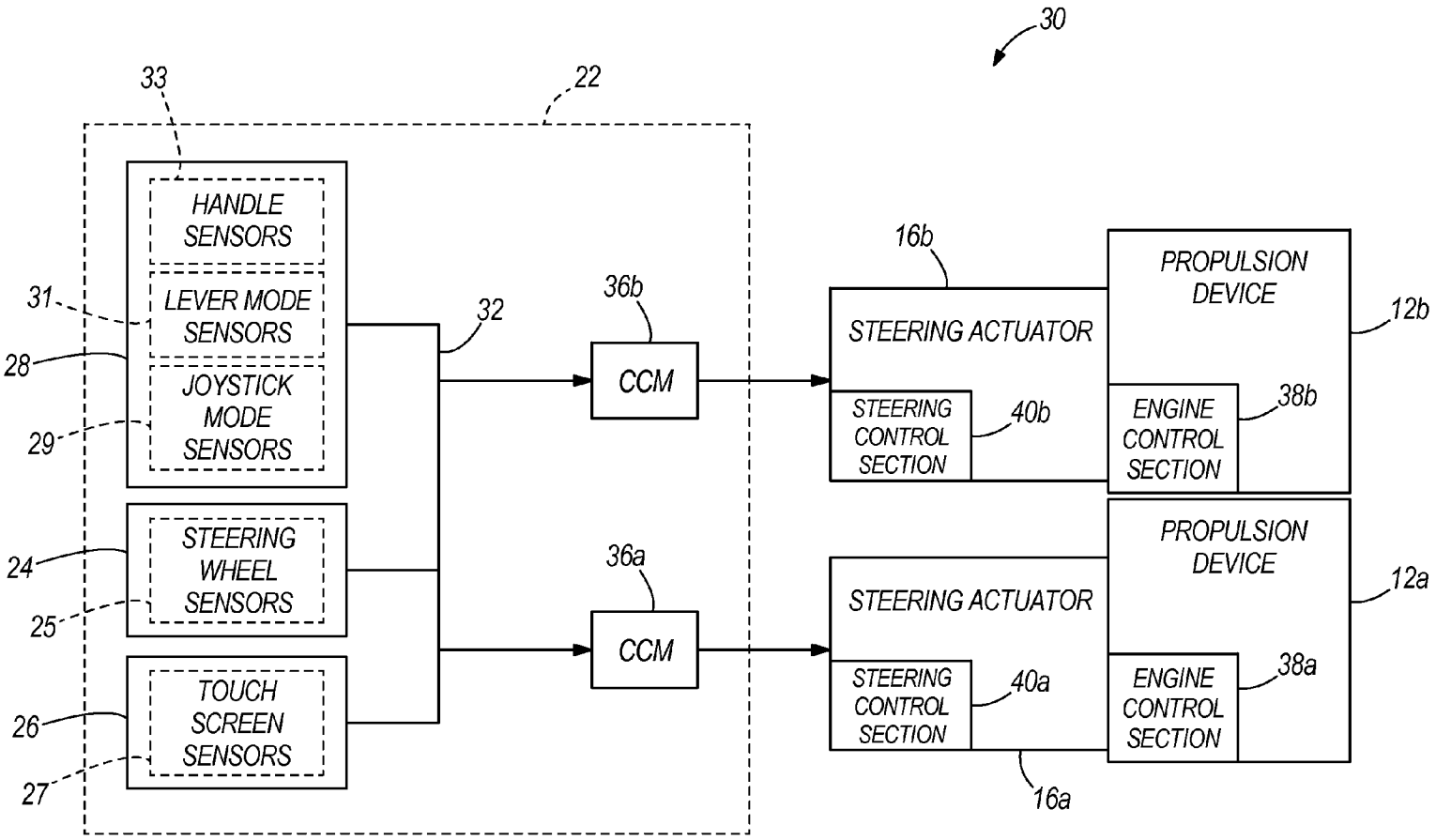
FIG. 7 is a schematic depiction of a control circuit for controlling the propulsion devices.

Referring now to FIG. 7, the devices 24, 26, 28 communicate with a control circuit 32, which in the example shown is part of a control circuit area network. In this example, the devices 24, 26, 28 each have one or more sensors for sensing operator movements of the respective device and communicating same to the control circuit 32. For example, the steering wheel 24 has conventional steering wheel sensors 25. The touch screen 26 has conventional touch screen sensors 27. As discussed further herein below, the device 28 has both joystick mode sensors 29 for sensing movement of the device 28 in joystick mode and lever mode sensors 31 for sensing movement of the device 28 in lever mode. Note that it is not required that the input devices 24, 26, 28 communicate with the control circuit 32 via a control circuit area network. For example, one or more of these items can be connected to the control circuit 32 by hardwire or wireless connection.

The control circuit 32 is programmed to control operation of the marine propulsion devices 12*a*, 12*b* and steering actuators 16*a*, 16*b* associated therewith. The control circuit 32 can have different forms. In the example shown, the control circuit 32 includes a plurality of command controls modules 36*a*, 36*b* located at the helm 22. A command control module 36*a*, 36*b* is provided for each of the port and starboard marine propulsion devices 12*a*, 12*b*. The control circuit 32 also includes engine control sections 38*a*, 38*b* located at and controlling operation of each respective propulsion device 12*a*, 12*b*, and a steering control section 40*a*, 40*b* located at and controlling operation of each respective steering actuator 16*a*, 16*b*. Each control section has a memory and a processor for sending and receiving electronic control signals, for communicating with other parts of the control circuit 32, and for controlling operations of certain components in the system 30 such as the operation and positioning of marine propulsion devices 12*a*, 12*b* and relating steering actuators 16*a*, 16*b*. The control circuit 32 is shown in simplified schematic form and can have any number of sections (including for example one section) and can be located remotely from or at different locations in the marine vessel 10 from that shown. It should be understood that the concepts disclosed in the present disclosure are capable of being implemented with different types of control systems, including systems that acquire global position data and real time positioning data, such as for example global positioning systems, inertial measurement units, and/or the like.

Figure 5:
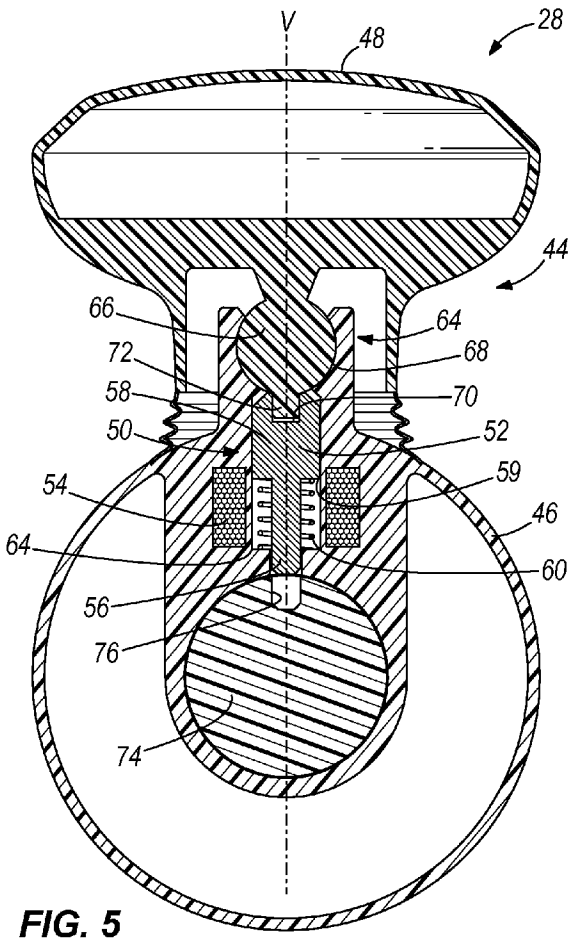
FIG. 5 is a side sectional view of the device configured for operation in a lever mode.
Figure 4:
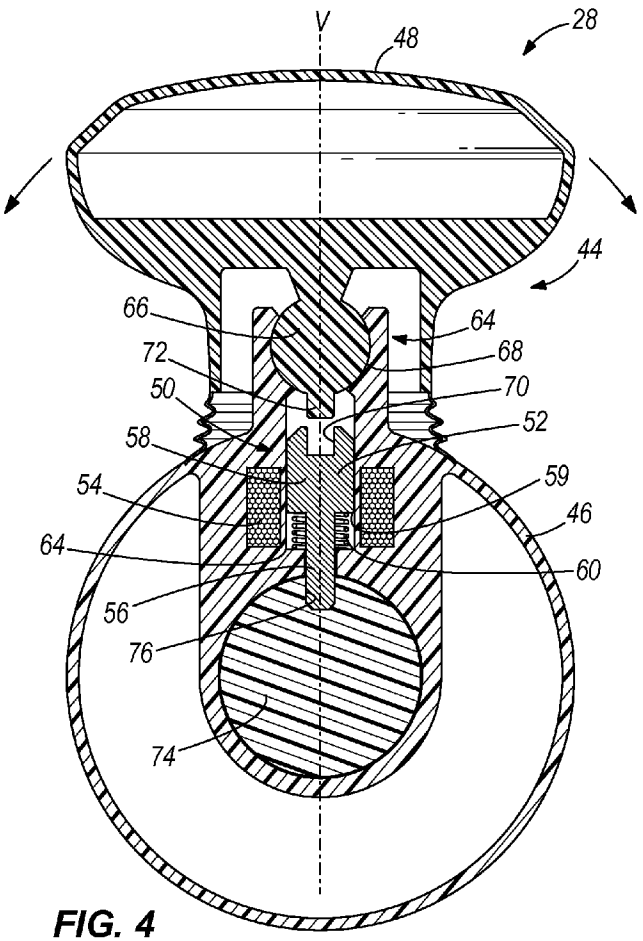
FIG. 4 is a side sectional view of the input device configured for operation in a joystick mode.
Figure 6:
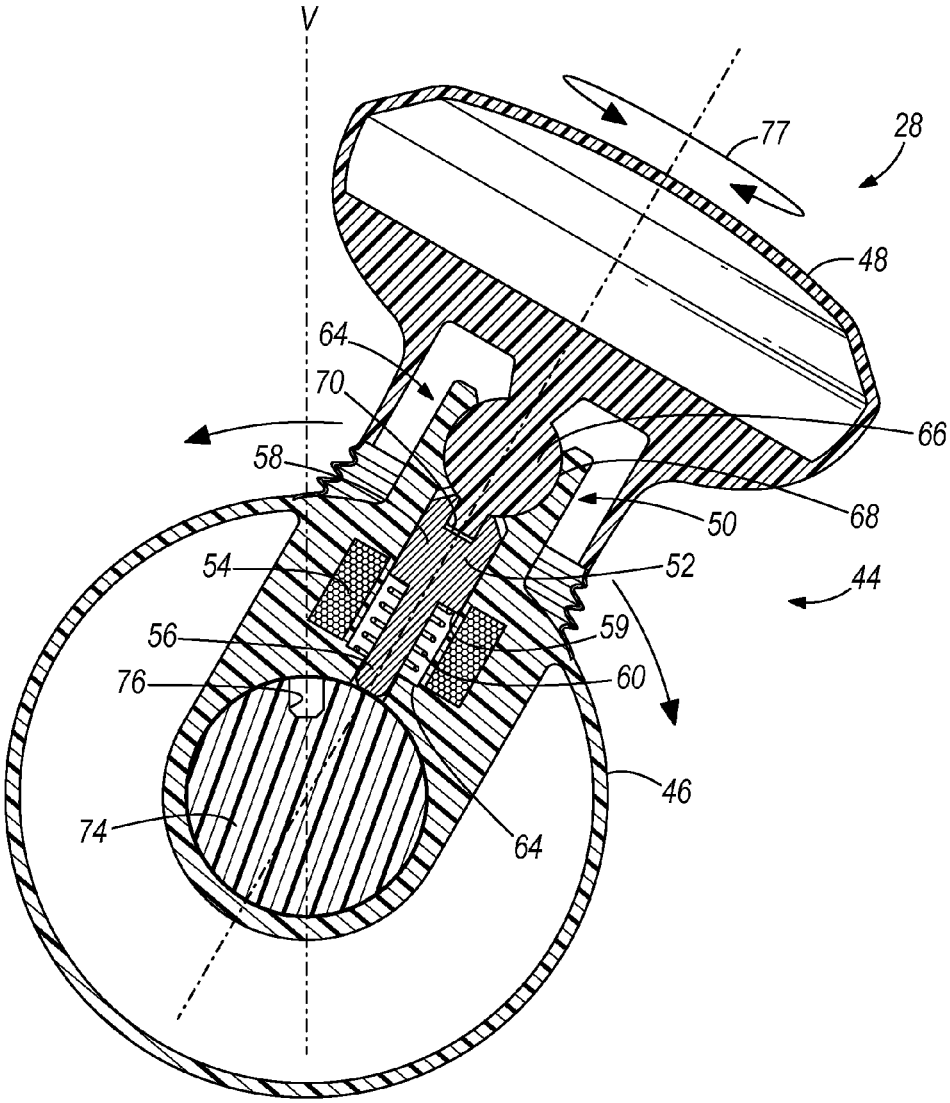
FIG. 6 is a side sectional view of the device rotated into a forward shift and throttle position in the lever mode.

FIGS. 4-6 depict side sectional views of the device 28. The device 28 generally includes a lever 44 having a housing 46 and a handle 48. As discussed above, the device 28 is selectively operable in both the joystick mode (see FIG. 4) and the lever mode (see FIGS. 5 and 6). In the joystick mode, the lever 44 is free to pivot in all directions away from a vertical axis V, which is perpendicular to the horizontal axis H, to thereby input throttle, shift and directional commands to the control system 30. The pivoting movement is shown schematically by four arrow heads in FIG. 3; however, movement at any angle between the direction of the arrow heads is facilitated. In the lever mode, the lever 44 is confined to pivoting about a horizontal axis H to thereby input throttle and shift commands to the control system 30. Movement of the lever 44 about the horizontal axis H is shown by two arrows in FIG. 6.

A lock 50 selectively locks the lever 44 for operation in one of the joystick mode and the lever mode and selectively unlocks the lever 44 for operation in the other of the joystick mode and the lever mode. The specific configuration of the lock 50 can vary from that which is shown. In the example shown, the lock 50 includes a pin 52 that is movable in the device 28 between a joystick mode position (see FIG. 4) and a lever mode position (see FIGS. 5 and 6). A solenoid 54 is operable to move the pin 52 between the noted positions. The pin 52 is made of ferrous material, and includes a shaft 56 and a head 58. The pin 52 is held in lever mode position with a spring 60 which has an upper end engaging a lower bearing surface 59 on the head 58 of the pin 52 and a lower end engaging with an inner bearing surface 64 on a housing 46. When current is allowed to flow through the spring 60, a magnetic force is created which acts on the pin causing it to compress the spring 60 thus moving it into the joystick mode position (FIG. 4). Deactivating the solenoid 54 allows the bias of the spring 60 to act on the surfaces 59, 64 to move the pin 52 from the joystick mode position to the lever mode position (FIGS. 5 and 6).

Referring to FIG. 4, a movable joint 64 facilitates pivoting of the handle 48 with respect to the housing 46 when the pin 52 is in the joystick mode position. The joint 64 includes a pivotable ball 66 that pivots about a seat 68. Movement of the ball 66 with respect to the seat 68 is sensed by conventional sensors 29 (FIG. 7), which in the example shown can be 0-5 volt Hall effect sensors. Potentiometers and/or the like could instead be utilized. Movement of the ball 66 with respect to the seat 68 causes movement of a plurality of conventional gimbal brackets (not shown) in the X and Y directions. Movement of the brackets is sensed by the noted sensors 29 and then input to the control circuit 32. This type of arrangement is conventional and further description is not necessary to enable one having ordinary skill in the art. Referring to FIG. 4, in joystick mode, the pin 52 is disengaged with the movable joint 64 to allow the above-mentioned pivoting movement of the movable joint 64. The pin 52 engages with a stationary shaft 74 and rotatably secures the housing 46 of the lever 44 with respect to the stationary shaft 74 to prevent pivoting of the housing 46 with respect to the stationary shaft 74 about the horizontal axis H. Specifically, the stationary shaft 74 includes a recess 76 that receives the shaft 56 of the pin 52 (FIG. 4), thus rotatably locking the two structures together and preventing the noted pivoting.

Referring to FIG. 5, in lever mode, the pin 52 engages with the movable joint 64 to prevent movement of the movable joint 64 and the handle 48 with respect to the housing 46. In this example, the head 58 of the pin 52 has a recess 70 for receiving a corresponding pin 72 extending from the movable joint 64. Engagement between the pin 72 in the movable joint 64 and the recess 70 in the head 58 effectively locks the joint 64 and prevents the noted pivoting of the joint 64. In the lever mode, the pin 52 does not engage with the stationary shaft 74 and thus the housing 46 is free to pivot about the stationary shaft 74 about the horizontal axis H. Conventional sensors 31 (FIG. 7) sense movement of the lever 44 with respect to the shaft 74. Movement of the lever 44 into a forward shift and throttle position is shown in FIG. 6. Similar movement into a reverse shift and throttle position is permitted in lever mode.

In use, an operator can select between the noted joystick mode and lever mode by first moving the lever 44 into a neutral position, such as the position shown in FIGS. 3-5 wherein the lever 44 is aligned with the vertical axis V. The operator then engages a mode select button either on the device 28, at the helm 22, or on the touchscreen 26, for example. Engagement of the mode select button energizes or de-energizes the lock 50 to switch the position of lock 50 from the joystick mode (FIG. 4) to the lever mode (FIG. 5) or vice versa. As described above, when the device 28 is configured for operation in joystick mode, the housing 46 is held stationary and the handle 48 is freely pivotable away from the vertical axis V. This is shown in FIG. 4. Conversely, when the device 28 is configured for operation in lever mode, the housing 46 is pivotable with respect to the horizontal axis H and the handle 48 is held stationary with respect to the housing 46. This is shown in FIGS. 5 and 6.

In both the lever mode and the joystick mode, the handle 48 is rotatable about the vertical axis V as shown at arrows 77 to thereby input differential thrust commands for controlling the port and starboard propulsion devices 12*a*, 12*b* at different throttles, respectively. In one example, rotation of the handle 48 with respect to the vertical axis V inputs differential thrust commands that increasingly vary the further the handle 48 is rotated. Rotational movement of the handle 48 can be sensed by a conventional sensor 33 (FIG. 7), which can be for example a Hall effect sensor.

Sensed movements of the lever 44 and handle 48 are thus communicated to the control circuit 30 in a conventional manner for processing by the command control modules 36*a*, 36*b* and respective steering control sections 40*a*, 40*b* and engine control sections 38*a*, 38*b* to obtain movement of the vessel 10 in accordance with the operator inputs.

Figure 8:
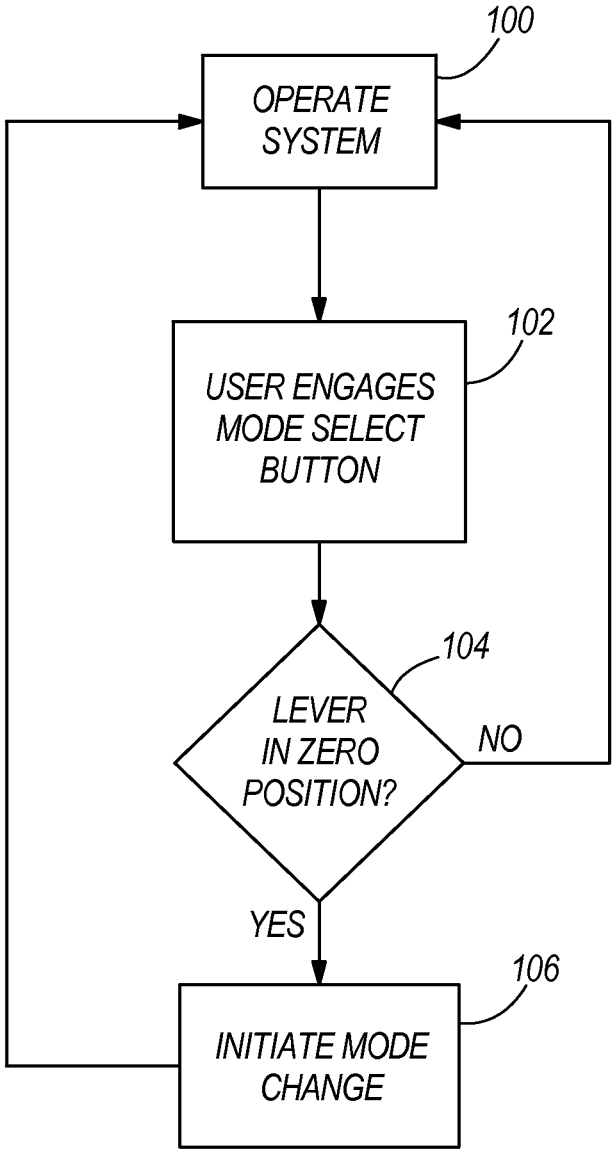
FIG. 8 is a flow chart depicting one example of a method of operating the input device.

Referring to FIG. 8, at step 100, the system 10 is operated under a prior operational mode such as lever mode or joystick mode. At step 102, the operator engages the mode select button. At step 104, the system determines whether the lever is located at the zero (i.e. vertical) position, such as the position shown in FIG. 3. This can be determined via a sensor located at the lever pivot point, such as at the stationary shaft 74. If no, the system continues to operate under the prior mode at step 100. If yes, the system initiates a mode change from joystick mode to lever mode or vice versa, at step 106. Initiation of the respective mode actuates the solenoid into or out of the positions shown in FIGS. 4 and 5, respectively.

What is claimed is:

1. A device for inputting command signals to a marine vessel control system, the device comprising a lever that is selectively operable in a joystick mode and a lever mode; wherein in the lever mode, the lever is confined to pivoting about a horizontal axis to thereby input throttle and shift commands to the control system; and wherein in the joystick mode, the lever is structured to be freely pivoted in all directions away from a vertical axis that is perpendicular to the horizontal axis to thereby input throttle, shift, and directional commands to the control system;

wherein the lever comprises a housing and a handle;

wherein in the lever mode, the housing is configured to pivot with respect to the horizontal axis and the handle is held stationary with respect to the housing; and wherein in the joystick mode, the housing is held stationary and the handle is configured to freely pivot in all directions away from the vertical axis;

a lock that is configured to selectively lock the lever for operation in one of the lever mode and joystick mode and unlock the lever for operation in the other of the lever mode and the joystick mode;

wherein the lock comprises a pin that is configured to move between a lever mode position and a joystick mode position;

a solenoid that is configured to move the pin between the lever mode position and the joystick mode position; and wherein the pin comprises a shaft and a head, wherein the solenoid comprises a spring, wherein activating the solenoid moves the pin from the lever mode position to the joystick mode position, and wherein deactivating the solenoid allows a bias of the spring to move the pin from the joystick mode position to the lever mode position.

2. The device according to claim 1, wherein the spring has an upper end that engages with a lower bearing surface on the head of the pin and a lower end that engages with an inner bearing surface on the housing.

3. The device according to claim 2, comprising a movable joint that is configured to facilitate pivoting of the handle with respect to the housing.

4. The device according to claim 1, wherein the handle is rotatable with respect to the vertical axis to input differential thrust commands for controlling multiple engines at different throttles, respectively.

5. The device according to claim 4, wherein rotation of the handle with respect to the vertical axis inputs differential thrust commands that increasingly vary the further the handle is rotated.

6. A device for inputting command signals to a marine vessel control system, the device comprising a lever that is selectively operable in a joystick mode and a lever mode; wherein in the lever mode, the lever is confined to pivoting about a horizontal axis to thereby input throttle and shift commands to the control system; and wherein in the joystick mode, the lever is structured to be freely pivoted in all directions away from a vertical axis that is perpendicular to the horizontal axis to thereby input throttle, shift, and directional commands to the control system;

wherein the lever comprises a housing and a handle;

wherein in the lever mode, the housing is configured to pivot with respect to the horizontal axis and the handle is held stationary with respect to the housing; and wherein in the joystick mode, the housing is held stationary and the handle is configured to freely pivot in all directions away from the vertical axis;

a lock that is configured to selectively lock the lever for operation in one of the lever mode and joystick mode and unlock the lever for operation in the other of the lever mode and the joystick mode;

wherein the lock comprises a pin that is configured to move between a lever mode position and a joystick mode position; and a movable joint that is configured to facilitate pivoting of the handle with respect to the housing; and wherein the pin engages with the movable joint in the lever mode position to prevent movement of the handle with respect to the housing.

7. The device according to claim 6, wherein the pin comprises a shaft and a head, wherein the head has a recess that is configured to receive a corresponding pin extending from the movable joint when in the lever mode, wherein engagement between the pin in the movable joint and the recess in the head effectively locks the gimbal and prevents movement of the movable joint.

8. The device according to claim 6, further comprising a stationary shaft about which the lever is rotatable, wherein the pin comprises a shaft that is configured to engage with the stationary shaft in the joystick mode position to prevent pivoting of the housing with respect to the horizontal axis.

9. The device according to claim 8, wherein the stationary shaft comprises a recess for that is configured to receive the shaft of the pin in the joystick mode position.

10. A device for inputting command signals to a marine vessel control system, the device comprising:

a housing;

a handle that is connected to the housing, wherein the handle extends along a first axis;

a stationary shaft that extends along a second axis that is perpendicular to the first axis, wherein the housing and the handle are configured to pivot together about the stationary shaft and about the second axis;

a joint that pivotably connects the handle to the housing such that the handle is pivotable with respect to the housing in all directions away from the first axis; and a lock that is configured to move back and forth between (a) a joystick mode position wherein the lock prevents pivoting of the handle and housing with respect to the second axis and allows pivoting of the handle with respect to the first axis, and (b) a lever mode position wherein the lock prevents pivoting of the handle with respect to the housing and allows pivoting of the handle and housing with respect to the stationary shaft;

wherein the joint comprises a ball that is connected to the handle and a seat for the ball, wherein the ball pivots in all directions with respect to the seat when the handle is pivoted in all directions away from the first axis.

11. The device according to claim 10, wherein the lock comprises a pin that is movable between the joystick mode position and the lever mode position, and further comprising a solenoid that is configured to cause the pin to move into the joystick mode position and into the lever mode position.

12. A device for inputting command signals to a marine vessel control system the device comprising:

a housing;

a handle that is connected to the housing, wherein the handle extends along a first axis;

a stationary shaft that extends along a second axis that is perpendicular to the first axis, wherein the housing and the handle are configured to pivot together about the stationary shaft and about the second axis;

a joint that pivotably connects the handle to the housing such that the handle is pivotable with respect to the housing in all directions away from the first axis; and a lock that is configured to move back and forth between (a) a joystick mode position wherein the lock prevents pivoting of the handle and housing with respect to the second axis and allows pivoting of the handle with respect to the first axis, and (b) a lever mode position wherein the lock prevents pivoting of the handle with respect to the housing and allows pivoting of the handle and housing with respect to the stationary shaft;

wherein the pin is made of ferrous material and further comprising a spring that is engaged with the pin;

wherein the spring comprises an upper end that is engaged with a bearing surface on the pin and a lower end that is engaged with a bearing surface on the housing, wherein activation of the solenoid causes an electrical current to flow through the spring and create a magnetic force that causes the pin to compress the spring and thus move the pin into one of the joystick mode position and the lever mode position, and wherein deactivation of the solenoid allows a bias of the spring to push on the bearing surface on the pin and the bearing surface on the housing to move the pin into the other of the joystick mode position and lever mode position.

13. The device according to claim 11, wherein the stationary shaft comprises a recess that is configured to receive the pin when the pin is moved into the joystick mode position and thereby prevent pivoting of the handle and housing with respect to the stationary shaft.

14. A device for inputting command signals to a marine vessel control system, the device comprising:

a housing;

a handle that is connected to the housing, wherein the handle extends along a first axis;

a stationary shaft that extends along a second axis that is perpendicular to the first axis, wherein the housing and the handle are configured to pivot together about the stationary shaft and about the second axis;

a joint that pivotably connects the handle to the housing such that the handle is pivotable with resect to the housing in all directions away from the first axis; and a lock that is configured to move back and forth between (a) a joystick mode position wherein the lock prevents pivoting of the handle and housing with respect to the second axis and allows pivoting of the handle with respect to the first axis, and (b) a lever mode position wherein the lock prevents pivoting of the handle with respect to the housing and allows pivoting of the handle and housing with respect to the stationary shaft;

wherein the lock comprises a pin that is movable between the joystick mode position and the lever mode position, and further comprising a solenoid that is configured to cause the pin to move into the joystick mode position and into the lever mode position; and wherein the pin comprises a head and a shaft, and wherein the head comprises a recess, and wherein the recess is configured to receive another pin that is on the joint when the lock is moved into the lever mode position and thereby prevent pivoting of the handle with respect to the housing.

* * * * *